United States Patent [19]

Chen et al.

[11] 4,426,280

[45] Jan. 17, 1984

[54] PROCESS FOR REMOVING NITROGEN FROM SHALE OIL

[75] Inventors: Paul Y. Chen, Huntington Beach; Ajay M. Madgavkar, Irvine, both of Calif.

[73] Assignee: Occidental Petroleum Corporation, Irvine, Calif.

[21] Appl. No.: 347,095

[22] Filed: Feb. 9, 1982

[51] Int. Cl.[3] ..... C10G 17/04

[52] U.S. Cl. ..... 208/254 R; 208/270

[58] Field of Search ..... 208/254 R

[56] References Cited

U.S. PATENT DOCUMENTS

| | | | |
|---|---|---|---|
| 2,035,102 | 3/1936 | Stratford et al. | 208/324 |
| 2,035,583 | 3/1936 | Bailey | 546/181 |
| 2,309,324 | 1/1943 | McAllister et al. | 546/1 |
| 2,541,458 | 2/1951 | Berg | 260/705 |
| 2,662,843 | 12/1953 | Castner et al. | 208/254 R |
| 2,848,375 | 8/1958 | Gatsis | 208/265 |
| 3,719,587 | 3/1973 | Karchmer et al. | 208/208 R |
| 4,071,435 | 1/1978 | Smith | 208/91 |
| 4,209,385 | 6/1980 | Stover | 208/254 R |
| 4,231,858 | 11/1980 | Seitzer et al. | 208/89 |
| 4,261,813 | 4/1981 | Smith | 208/254 H |
| 4,271,009 | 6/1981 | Stover et al. | 208/254 R |
| 4,272,361 | 6/1981 | Compton | 208/254 R |

*Primary Examiner*—Curtis R. Davis
*Assistant Examiner*—O. Chaudhuri
*Attorney, Agent, or Firm*—Christie, Parker & Hale

[57] ABSTRACT

There is provided a process for reduction of the nitrogen content of shale oil. The process comprises contacting shale oil with a low acid strength solvent in a first extraction zone, followed by contacting the shale oil with a high acid strength solvent in a second extraction zone. A portion of the high acid strength solvent containing extracted nitrogen-containing and non-nitrogen-containing compounds is passed to the first extraction zone and diluted to form low acid strength solvent, and at least a portion of the non-nitrogen-containing compounds redissolve into the shale oil in contact with the low acid strength solvent and are recovered. Thus, oil recovery is maximized at high nitrogen removal.

47 Claims, 2 Drawing Figures

PROCESS FOR REMOVING NITROGEN FROM SHALE OIL

BACKGROUND OF THE INVENTION

The process herein relates to reducing the nitrogen content of shale oil by contacting the shale oil with a substantially immiscible solvent.

The term "oil shale" as used in the industry is a sedimentary formation comprising marlstone deposits with layers containing an organic polymer called "kerogen" which, upon heating, decomposes to produce liquid and gaseous products. The formation containing kerogen is called "oil shale" herein and the liquid product produced upon decomposition of kerogen is called "shale oil".

In a preferred practice of the method described herein, the method is utilized for refining shale oil produced from in situ retorting of oil shale. An in situ oil shale retort can be formed by many methods, such as the methods disclosed in U.S. Pat. Nos. 3,661,423; 4,043,595; 4,043,596; 4,043,597; and 4,043,598, all of which are incorporated herein by this reference.

Although the process disclosed herein of reducing the nitrogen content of shale oil is primarily discussed in relation to shale oil produced from the in situ retorting of oil shale, the process can be practiced on shale oil produced by other methods of retorting. Many of these methods for shale oil production are described in *Synthetic Fuels Data Handbook*, compiled by Dr. Thomas A. Hendrickson, and published by Cameron Engineers, Inc., Denver, Colo. For example, other processes for retorting oil shale include those known as the TOSCO, Paraho Direct, Paraho Indirect, N-T-U, and Bureau of Mines, Rock Springs, processes.

Kerogen is considered to have been formed by the deposition of plant and animal remains in marine and nonmarine environments. Its formation is unique in nature. Alteration of this deposited material during subsequent geological periods produced a wide variety of organic materials. Source material and conditions of deposition were major factors influencing the type of final product formed.

Kerogen samples, found in various parts of the world, have nearly the same elemental composition. However, kerogen can consist of many different compounds having differing chemical structures. Some compounds found in kerogen have the structures of proteins while some have structures of terpenoids, and others have structures of asphalts and bitumens.

Shale oils are generally high molecular weight, viscous organic liquids, of predominantly hydrocarbonaceous oxygen, nitrogen and sulfur-containing organic compounds produced from oil shale. The shale oils are of varying linear, branched cyclic, aromatic hydrocarbon and substituted hydrocarbon content with high pour points, moderate sulfur content and relatively high nitrogen content. The shale oil produced from an oil shale formation can vary between strata within the oil shale formation. The nitrogen content of shale oil can also vary dependent upon the geographical location of the oil shale deposit from which the shale oil is produced. Such a variance in nitrogen content in different geographical locations can be attributed to differences in the environment during the time of the deposition of the organisms which, upon lithification, become oil shale. Such a variance can also be attributed to the different types of organisms in the separate geographical locations which were deposited to form the organic substance in the oil shale and any organisms within the formed deposit layer which acted upon such deposited material to provide the kerogen within the oil shale formation. Furthermore, the nitrogen content of shale oil may vary according to the process and operating variables used to produce it.

The nitrogen content in shale oil is attributable to basic nitrogen-containing compounds and non-basic nitrogen-containing compounds. The relative percentages of the basic and non-basic nitrogen compounds comprising the total nitrogen content of a shale oil varies depending upon the particular shale oil but typically are in the ranges of 60% to 70% basic nitrogen-containing compounds and 30% to 40% non-basic nitrogen-containing compounds.

The nitrogen content of shale oil is generally up to about two percent by weight. For example, the average nitrogen content of shale oil recovered by in situ retorting of oil shale from the Piceance Creek Basin of Western Colorado is on the order of about 1.4% by weight. This is very high when compared with the nitrogen content of crude petroleum which is typically up to about 0.2% by weight.

The presence of nitrogen in shale oil presents many problems in that the nitrogen can interfere with the transportation and use of the shale oil. Deleterious effects brought about by the presence of nitrogen in shale oil are decreased catalyst life in hydrogenation, reforming, hydrocracking and catalytic cracking reactions, decreased chemical stability of products, and decreased color stability of products. Another problem with the presence of nitrogen in shale oil is that it is undesirable to transport nitrogen-containing shale oil through pipelines which are also used for transporting petroleum products because of possible contamination of such products with residual nitrogen-containing shale oil in the pipeline. Generally such petroleum products contain a very low nitrogen content. The relatively high nitrogen content in the shale oil can pollute the pipelines making them undesirable and uneconomical for transporting such low nitrogen-containing petroleum products. In addition, high nitrogen content in shale oil can cause clogging of pipelines due to self-polymerization brought about by the reactivity of the nitrogen-containing compounds. Due to the basicity of the nitrogen-containing compounds in shale oil, some corrosion can occur, thus damaging a pipeline used to transport shale oil.

Product stability is a problem that is common to many products derived from shale oil with the major exception of the asphalt cut and those products that have undergone extensive hydrotreating. Such instability, including photosensitivity, is believed to result primarily from the presence of nitrogen-containing compounds.

It is, therefore, desirable to reduce the nitrogen content of shale oil to increase the utility, transportability, and stability of the shale oil and the products derived from such shale oil.

Due to the undesirable nature of nitrogen in organic fluid streams, such as fluid streams produced in the recovery and refining of petroleum, coal and oil shale, many processes have been developed to reduce the nitrogen content to an acceptable level. The level of acceptability for the nitrogen content is generally based upon the use of the particular stream.

In U.S. Pat. No. 3,719,587 to Karchmer et al, a process is disclosed for removing basic nitrogen-containing compounds from coal naphtha. The basic nitrogen compounds are removed by washing the naphtha with water or with a dilute aqueous solution of an acid. The dilute acid solutions are disclosed as sulfuric acid, hydrochloric acid, phosphoric acid and acetic acid.

U.S. Pat. No. 2,848,375 to Gatsis discloses a process for removing basic nitrogen compounds from organic substances by washing with a weak acid in combination with a polyalcohol. The weak acid used is boric acid in combination with a polyhydroxy organic compound which has hydroxyl groups on adjacent carbons.

U.S. Pat. No. 2,035,583 to Bailey discloses a process for the separation and recovery of nitrogen bases from mineral oils. In the process, the mineral oil is extracted with a solvent for the nitrogen bases. Acceptable solvents are liquid sulfur dioxide, furfural, aniline, nitrobenzene and isobutyl alcohol. However, due to the solubility of desirable mineral oils, such as aromatics and olefines, the process also includes extracting the resultant extract with dilute aqueous acids to recover the nitrogen bases from the first extract. The nitrogen bases are then recovered from the aqueous solution by adding an inorganic base to precipitate the nitrogen bases.

U.S. Pat. No. 2,035,012 to Stratford et al discloses a process for improving the color and viscosity of petroleum oils. In the process an oil is extracted with a selective solvent in combination with an acid. The selective solvent can be phenol, nitrobenzene, furfural or liquid sulfur dioxide. The acid is preferably an inorganic acid but can also be an organic acid such as picric, acetic, oxalic, and citric acids.

U.S. Pat. No. 2,541,458 to Berg discloses a process for recovery of nitrogen bases from hydrocarbon fractions. In the process the fraction is extracted with a volatile acid or non-volatile acid salt in combination with a mutual solvent for the acid and the hydrocarbon fraction. The mutual solvents include low boiling alcohols and ketones. The extraction is conducted in the presence of water to avoid loss of the volatile acids.

U.S. Pat. No. 2,309,324 to McAllister et al discloses a method for removing nitrogen bases from water-insoluable organic solvents, mineral oils and hydrocarbon fractions. In the process the mineral oil is extracted with an aqueous, weak acid solution. The weak acids are classified as acids having dissociation constants below $10^{-3}$. The aqueous acid solutions are prepared by dissolving from 15 to 90 weight percent of an acid in water. Upon extraction of the oil, two phases are formed. The aqueous phase contains the acid and absorbed nitrogen bases. The other phase consists of the organic substance from which at least a portion of the nitrogen bases has been removed.

U.S. Pat. No. 2,662,843 to Castner et al discloses a method to reduce the nitrogen content of shale oil by contacting the shale oil with from two to ten stoichiometric proportions of formic acid for each proportion of nitrogen present in the shale oil.

U.S. Pat. No. 4,071,435 to Smith describes a process for reducing the nitrogen content of syncrude feed wherein syncrude feed is contacted with an aqueous solution containing an extractant-catalyst which is effective for extracting nitrogen-containing compounds from the syncrude feed and for serving as a hydrocracking catalyt for the syncrude feed. Extractant-catalysts include halides of zinc, cadmium, mercury, lead and copper.

U.S. Pat. No. 4,272,361 to Compton discloses a method for reducing the nitrogen content of shale oil by contact with a solvent comprising an active solvent for nitrogen-containing compounds and sufficient water to provide phase separation. The active solvent is selected from the group consisting of organic acids and substituted organic acids.

U.S. Pat. No. 4,209,385 to Stover discloses a method for reducing the nitrogen content of shale oil wherein the shale oil is contacted with a mixture comprising an organic acid and a mineral acid. The organic acid is selected from organic acids and substituted organic acids. The mineral acid is selected from the group consisting of hydrochloric acid, nitric acid, nitrous acid, sulfuric acid, sulfurous acid, phosphorus acid, and mixtures thereof.

U.S. Pat. No. 4,261,813 to Smith describes a method for denitrogenating an oil having a high nitrogen content wherein nitrogenous compounds are extracted with an operable acid solvent. Preferred solvents comprise phosphoric acid, formic acid and the monoammonium salt of phosphoric acid.

U.S. Pat. No. 4,271,009 to Stover discloses a method for reducing the nitrogen content of shale oil which comprises lowering the viscosity of the shale oil and then contacting the shale oil with a solvent comprising water and an organic acid selected from the group consisting of organic acids and substituted organic acids.

U.S. Pat. No. 4,231,858 discloses a method of reducing the nitrogen content of shale oil wherein crude shale oil is contacted with a catalyst and hydrogen at a temperature of about 600° F. and a pressure of about 200 psig to about 5000 psig until a substantial amount of nitrogen-containing compounds is converted to basic nitrogen compounds. The basic nitrogen compounds are contacted with dry hydrochloric acid and the reaction product is removed from the oil.

Many of the processes described in the above patents do not address themselves to the removal of non-basic nitrogen compounds which can be present in organic fluids. Additionally, many of the above-described processes are not specific for treatment of shale oil and the relatively high nitrogen content found in shale oil.

In processes capable of acid solvent extraction of nitrogen-containing compounds, a portion of the hydrocarbons in the shale oil are removed. Increased concentration of the acid solvent removes greater amounts of nitrogen-containing compounds but also extracts greater amounts of hydrocarbons, thereby reducing the hydrocarbon recovery. Accordingly, it is desirable to improve the selectivity of a process towards the removal of nitrogen-containing compounds to thereby provide a process capable of high nitrogen-containing compound extraction along with high hydrocarbon recovery.

SUMMARY OF THE INVENTION

In accordance with the present invention, there is provided a process for removal of nitrogen-containing compounds in shale oil. The process comprises first contacting shale oil with a substantially immiscible low acid strength solvent having high selectivity towards extracting nitrogen-containing compounds from shale oil but a low capacity for removal of nitrogen-containing compounds. The low acid strength solvent comprises water and at least one additional component.

Following contact with the low acid strength solvent, the shale oil is separated and contacted with a substantially immiscible high acid strength solvent having low selectivity towards extracting nitrogen-containing compounds from shale oil but a high capacity for the removal of nitrogen-containing compounds. High acid strength solvent comprises water and the same additional component or components as present in the low acid strength solvent.

Shale oil having reduced nitrogen content is separated from the high acid strength solvent. A portion of the high acid strength solvent is diluted to form low acid strength solvent and combined with the low acid strength solvent. Non-nitrogen-containing compounds extracted by the diluted high acid strength solvent preferentially redissolve into shale oil contacting the low acid strength solvent while nitrogen-containing compounds are selectively retained.

The additional component or components in both the low acid strength solvent and the high acid strength solvent are selected from the group consisting of acids having a dissociation constant greater than about $1\times10^{-6}$ and salts thereof. The preferred components are organic acids. The concentration of the additional component in the high strength acid solvent is greater than the concentration of the additional component in the low acid strength solvent.

In a preferred embodiment, shale oil, in separate portions or as a continuous stream, is introduced to a first extraction zone containing low acid strength solvent.

The shale oil is separated from the low acid strength solvent and passed to a second extraction zone containing high acid strength solvent wherein nitrogen-containing and non-nitrogen-containing compounds are extracted. A portion of the low acid strength solvent is removed from the first extraction zone as extract and a portion of the high acid strength solvent containing nitrogen-containing and non-nitrogen-containing compounds from the second extraction zone is diluted to thereby form low acid strength solvent and passed to the first extraction zone wherein at least a portion of the non-nitrogen-containing compounds redissolve into the shale oil contacting the low acid strength solvent. Nitrogen-containing compounds are selectively retained by the low acid strength solvent.

In another preferred embodiment, a stream of shale oil is introduced to a first extraction zone at the lower end of an extraction vessel and countercurrently contacts a downwardly flowing solvent stream of low acid strength solvent in the first extraction zone and then high acid strength solvent in a second extraction zone at the upper end of the extraction vessel which thereby selectively extracts nitrogen-containing compounds.

The concentration differential in the solvent stream is achieved by diluting the high acid strength solvent stream with water and/or low acid strength solvent at one or more locations between the first and second extraction zones. Low acid strength solvent containing nitrogen-containing compounds exits the lower end of the extraction zone as extract.

BRIEF DESCRIPTION OF THE DRAWINGS

These and other features and advantages of the present invention will be better understood by reference to the following detailed description when considered in conjunction with the accompanying drawings wherein.

DETAILED DESCRIPTION

Figure 1:
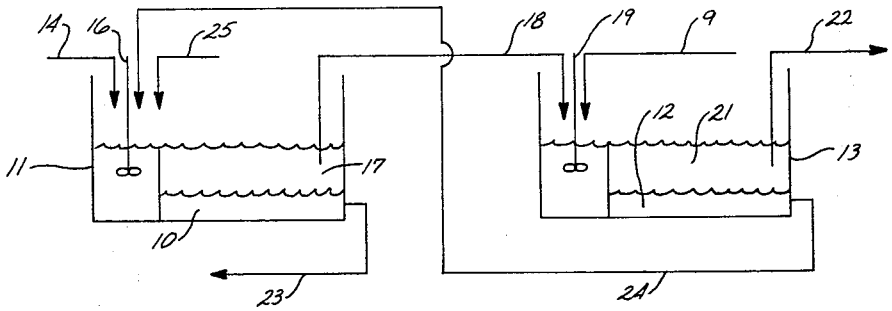
FIG. 1 is a flow diagram of a preferred embodiment of the invention comprising two mixer-settlers.

This invention relates to the refining of shale oil and, more particularly, to the reduction of the nitrogen content of shale oil.

As used herein, the term "crude shale oil" refers to the liquid product that is recovered from retorting of oil shale. The term encompasses liquid products formed during the retorting processes or in situ oil shale retorting processes, which products have not undergone any further processing other than water removal or emulsion breaking. The term "processed shale oil" is used herein to indicate a crude shale oil which has undergone some processing, such as, for example, sulfur removal, fractionation, and the like. As used herein, the term "refined shale oil" refers to a crude shale oil or a processed shale oil which has been processed through the method of this invention to reduce the nitrogen content of such shale oil. The "refined shale oil," therefore, has a lower nitrogen content than the crude shale oil or processed shale oil undergoing the method herein disclosed.

As used herein, low acid strength solvent means an aqueous acid having a relatively lower acid strength, and high acid strength solvent means an acid having a relatively higher acid strength.

Low acid strength solvents which are suitable for extracting nitrogen-containing compounds from shale oil comprise a mixture of water and at least one additional component selected from the group consisting of acids having a dissociation constant above about $1\times10^{-6}$ and salts thereof. Acids may be organic or inorganic or mixtures of two or more acids. Exemplary acids include hydrochloric acid, phosphoric acid, acetic acid, formic acid and trichloroacetic acid.

It is preferred that an organic acid be used because inorganic acids and salts have a greater tendency to form emulsions with shale oil and therefore require longer separation times. The most preferred acids are acetic acid and formic acid. Low acid strength solvents have high selectivity toward extracting and retaining nitrogen-containing compounds but have low capacity for the removal of nitrogen-containing compounds from shale oil, i.e., such solvents remove a low percentage of nitrogen-containing compounds.

High acid strength solvents which are suitable for extracting nitrogen-containing compounds from shale oil comprise a mixture of water and at least one additional component selected from the group of acids having a dissociation constant greater than about $1\times10^{-6}$ and salts thereof. The additional component or components are the same as in the low acid strength solvent and may be organic or inorganic acids or their salts or mixtures thereof. The preferred additional components are organic acids and the most preferred acids are acetic acid and formic acid. If a mixture of two or more additional components are used, the concentration ratio of additional components in the high acid strength solvent is substantially the same as in the low acid strength solvent.

High acid strength solvents have a lower selectivity toward extraction and retention of nitrogen-containing compounds but have a greater capacity for their removal i.e., such solvents remove a higher percentage of nitrogen-containing compounds than low acid strength solvents. Due to its lower selectivity towards extracting nitrogen-containing compounds, high acid strength solvents extract a significant portion of the desirable non-nitrogen-containing compounds.

As used herein, "substantially immiscible" solvents refers to solvents that are immiscible in shale oil and, additionally, solvents that are partially miscible in shale oil in an amount less than about 5% by weight of the shale oil.

Nitrogen-containing compounds are removed from shale oil in a process by first introducing crude or processed shale oil as a continuing stream or in separate portions to a first extraction zone containing a substantially immiscible low acid strength solvent having a high selectivity for extracting and retaining nitrogen-containing compounds but a low capacity for removal of nitrogen-containing compounds, and then passing the shale oil to a second extraction zone containing a substantially immiscible high acid strength solvent having a lower selectivity for extracting and retaining nitrogen-containing compounds but providing a higher capacity for removal of nitrogen-containing compounds. The low acid strength solvent removes a relatively low percentage of nitrogen-containing compounds from shale oil and the high acid strength solvent removes a higher percentage of nitrogen-containing compounds from the shale oil.

Low acid strength solvent is drawn off continuously or in portions as extract. High acid strength solvent containing extracted nitrogen-containing and non-nitrogen-containing compounds is diluted to form low acid strength solvent and passed continuously or in portions to the first extraction zone, thereby maintaining a desired volume of low acid strength solvent. Fresh high acid strength solvent containing little or no nitrogen-containing compounds is added to the second extraction zone to maintain the high acid strength solvent at a desired volume.

A high acid strength solvent extracts a substantial portion, i.e., up to about 95%, of the nitrogen-containing compounds from the shale oil. However, due to its low selectivity, it also extracts a significant amount of desirable non-nitrogen-containing compounds. The concentration equilibrium that is reached between high acid strength solvent and shale oil in contact with the high acid strength solvent depends upon the concentration of nitrogen-containing and non-nitrogen-containing compounds in the two-phase mixture along with their relative solubilities in each phase and the relative volumes of each phase.

As high acid strength solvent is diluted, the solubility of nitrogen-containing and non-nitrogen-containing compounds is reduced, the solubility of non-nitrogen-containing compounds being reduced to a greater extent, thus accounting for the improved selectivity of low acid strength solvents towards retention of nitrogen-containing compounds. In a system wherein low acid strength solvent that is substantially saturated with nitrogen-containing compounds contacts shale oil having a full complement of nitrogen-containing compounds, the low acid strength solvent will retain more nitrogen-containing compounds than in a system wherein the low acid strength solvent is substantially free of nitrogen-containing compounds and contacts the same shale oil. This is because there is a higher concentration of nitrogen-containing compounds in both phases in the former system than in the latter.

As the high acid strength solvent is diluted to form low acid strength solvent and its capacity to retain both nitrogen-containing and non-nitrogen-containing compounds decreases, the equilibrium between the low acid strength solvent phase and the shale oil phase shifts such that nitrogen-containing and non-nitrogen-containing compounds in the low acid strength solvent begin to dissolve into the shale oil phase. However, the selectivity towards retaining nitrogen-containing compounds increases, leading to preferential retention of nitrogen-containing compounds.

This process combines the high removal capacity for nitrogen-containing compounds found in high acid strength solvents and the high selectivity towards extracting and retaining nitrogen-containing compounds found in low acid strength solvents.

The amount of water mixed with the additional component in the low acid strength solvent is lower than the amount mixed with the additional component in the high acid strength solvent. For the preferred additional components, i.e., organic acids, the amount of water is in the range of from about 30% to about 95% and preferably from about 50% to about 70%, depending on the acid selected. The amount of water is sufficient to make the acid substantially immiscible with shale oil. The amount of water is selected to achieve the desired selectivity toward extraction and retention of nitrogen-containing compounds. Too little water results in a loss of selectivity and lowers the recovery of desirable non-nitrogen-containing compounds. Excessive water results in a loss of solubility of both nitrogen-containing and non-nitrogen-containing compounds, leading to insufficient reduction of the nitrogen content of the shale oil.

The amount of nitrogen-containing compounds extracted from the shale oil is related to the concentration of the acid component in the solvent. Low acid strength solvents extract and retain less nitrogen-containing compounds than high acid strength solvents.

The amount of water mixed with the additional component in the high acid strength solvent is less than that present in the low acid strength solvent. For the preferred additional components, i.e., organic acids, the amount of water is in the range of from about 0% to about 50% and preferably from about 10% to about 30%, depending on which acid is selected. The amount of water is sufficient to make the acid substantially immiscible with shale oil. The amount of water further provides phase disengagement sufficient for effectively separating the high acid strength solvent containing nitrogen-containing compounds from the shale oil. The amount of water is also sufficient to prevent significant loss of the acid portion of the low acid strength solvent by being dissolved in the shale oil. The amount of water is limited to assure that a high percentage of the nitrogen-containing compounds are extracted by the high acid strength solvent. Excessive water results in an insufficient amount of nitrogen-containing compounds being extracted from the shale oil.

The invention can be practiced in one embodiment by a two-stage extraction process as shown in FIG. 1. Low acid strength solvent 10 is incorporated in a first mixer-settler 11 which forms a first extraction zone and high acid strength solvent 12 in a second mixer-settler 13 which forms a second extraction zone. Crude or processed shale oil is introduced to the first extraction zone by a line 14. The shale oil and the low acid strength solvent are mixed by mixer 16 to achieve equilibrium rapidly. Average residence time in the mixing stage is about 2 to 3 minutes. Following mixing, about 15 to 60 minutes is usually required for settling of the lower solvent phase sufficient for subsequent separation of the phases. The upper shale oil phase 17 is then separated from the immiscible low acid strength solvent by conventional liquid-liquid separation techniques, e.g., decanting.

Low acid strength solvent is drawn off continuously or in portions through a line 23 as an extract for further processing of the nitrogen-containing compounds. The shale oil from the first extraction zone is passed by a line 18 to the second extraction zone 13 and mixed by a mixer 19 as described above, wherein nitrogen-containing compounds are extracted by the high acid strength solvent. Following contact with the high acid strength solvent, the two phases are allowed to settle and separate and the upper refined shale oil phase 21 is removed by conventional liquid-liquid separation techniques and passed to further processing by a line 22. Make-up high acid strength solvent is added by line 9.

The volume ratio of high acid strength solvent to shale oil that is required for extracting nitrogen-containing compounds from shale oil depends upon the nitrogen content in the shale oil and the solubility of such nitrogen-containing compounds in the selective solvent. The volume ratio of high acid strength solvent to shale oil is selected to provide that, after equilibrium has been reached between the two phases, the high acid strength solvent is substantially saturated with nitrogen-containing and non-nitrogen-containing compounds and the concentration of nitrogen-containing compounds remaining in the refined shale oil is about as low as can be obtained in contact with the saturated solvent phase. This assures that as high acid strength solvent is diluted, for forming low acid strength solvent, the equilibrium existing between low acid strength solvent and shale oil will cause at least a portion of the non-nitrogen-containing compounds in the solvent phase to dissolve into the shale oil phase.

For the preferred acids, the ratio of high acid strength solvent to shale oil is in the range of from about 0.1 to about 4 parts by volume high acid strength solvent to one part by volume shale oil and preferably from about 0.2 to about one part by volume high acid strength solvent to one part by volume shale oil. The most preferred ratio of high acid strength solvent to shale oil maximizes the amount of nitrogen-containing compounds extracted from the shale oil while forming a substantially saturated high acid strength solvent solution, i.e., high acid strength solvent saturated with nitrogen-containing compounds.

An amount of the substantially saturated high acid strength solvent containing nitrogen-containing compounds from the second extraction zone is passed continuously or in portions by a line 24 to the mixing stage of the first extraction zone and sufficient water is added by a line 25 to maintain the desired concentration of the low acid strength solvent. By thus diluting the substantially saturated high acid strength solvent to the concentration of low acid strength solvent, the concentration of nitrogen-containing and non-nitrogen-containing compounds in the low acid strength solvent is above the saturation concentration of the low acid strength solvent and hence a portion of the nitrogen-containing and non-nitrogen-containing compounds are redissolved into the shale oil phase. However, nitrogen-containing compounds extracted by the high acid strength solvent are preferentially redissolved by the low acid strength solvent due to the greater selectivity toward nitrogen-containing compounds. Desirable non-nitrogen-containing compounds preferentially reddisolve in the shale oil leading to high oil recovery.

Figure 2:
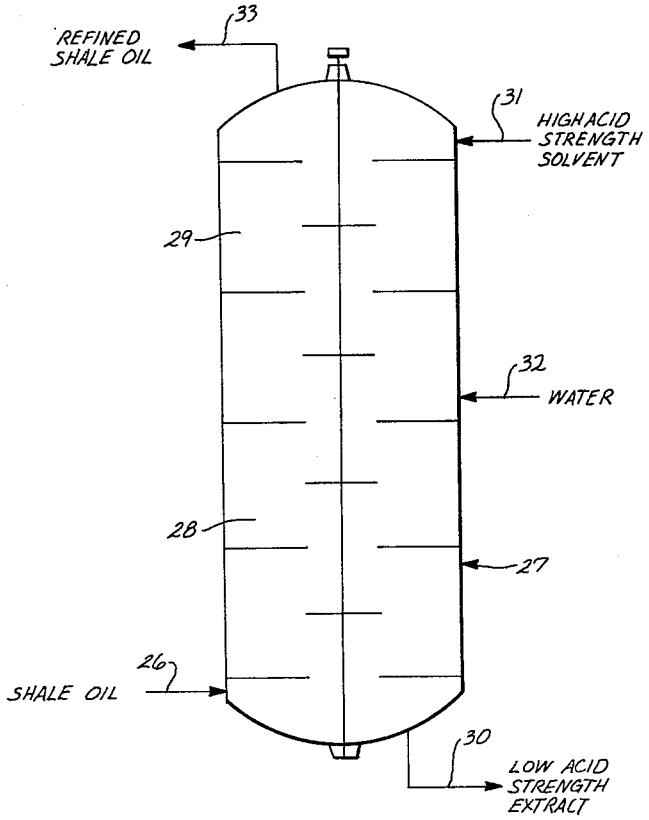
FIG. 2 is a schematic of a preferred embodiment of the invention comprising a countercurrent contactor.

In another preferred embodiment as shown in FIG. 2, nitrogen-containing compounds are removed in a continuous extraction process. A stream of shale oil is introduced through a line 26 to a vertical extraction vessel 27. Any conventional countercurrent contactor, e.g., a rotating disc contactor, may be used as the extraction vessel. The extraction vessel contains a downwardly flowing acid solvent stream comprising low acid strength solvent in a first extraction zone 28 at the lower end of the extraction vessel continuous with high acid strength solvent in a second extraction zone 29 at the upper end of the extraction vessel.

The concentration differential in the solvent stream is achieved by introducing a high acid strength solvent stream through a line 31 to the upper end of the extraction vessel and allowing it to flow toward the lower end. At a location between the ends of the extraction vessel, water and/or low acid strength solvent is added by a line 32 to the high acid strength solvent stream in an amount sufficient to dilute the high acid strength solvent to thereby form a low acid strength solvent stream which exits the lower end of the extraction vessel as extract by a line 30.

The shale oil feed stream introduced to the lower end of the extraction vessel first contacts the low acid strength solvent. The shale oil stream, which is less dense than the acid solvent stream, flows upwardly countercurrent to the flow of the acid solvent stream and contacts the high acid strength solvent in the upper end of the extraction vessel. At the top of the extraction vessel, refined shale oil having reduced nitrogen content is separated from the high acid strength solvent and removed by line 33.

Non-nitrogen-containing compounds extracted by the high acid strength solvent, are recovered by the shale oil in the lower end of the extraction zone following dilution of the high acid strength solvent.

The refined shale oil having reduced nitrogen content may be washed with water to extract solvent components that have dissolved into the shale oil during the extraction process. The shale oil is then separated from the aqueous wash and passed to further processing. The aqueous wash comprising recovered solvent components may be used to dilute high acid strength solvent, thereby recycling the solvent component.

Low acid strength solvent extract from the first extraction zone contains nitrogen-containing compounds. The solvent can be recovered by removing the nitrogen-containing compounds. For example, some of the nitrogen-containing compounds that are basic can be precipitated from the solvent by adding a stronger base, or the nitrogen-containing compounds can be extracted from the solvent in another extraction process. In another method, the solvent can be volatilized and recovered to separate it from the nitrogen-containing compounds. The solvent so recovered can be concentrated and/or recycled for use in subsequent extraction steps to reduce the nitrogen content of other shale oil.

The extracted nitrogen-containing compounds recovered from the low acid strength solvent can be useful because of the high nitrogen content. For example, the extracted nitrogen-containing compounds can be used in the production of other nitrogen compounds and various chemical intermediates containing nitrogen. When the selective solvent is volatilized, the residue can be used as asphalt which provides good adhesive properties because of its nitrogen content and ability to crosslink through nitrogen.

The low nitrogen content refined shale oil can be further processed by conventional techniques as a refinery or petrochemical feedstock.

What is claimed is:

1. A process for removal of nitrogen-containing compounds from shale oil, comprising:

contacting shale oil containing nitrogen-containing compounds with an aqueous low acid strength solvent comprising at least one component selected from the group consisting of acids having a dissociation constant greater than about $1\times10^{-6}$ and salts thereof;

separating the shale oil from the low acid strength solvent;

contacting the separated shale oil with an aqueous high acid strength solvent comprising the same component as in the low acid strength solvent wherein the concentration of the component is greater than in the low acid strength solvent sufficiently to extract non-nitrogen-containing compounds and nitrogen-containing compounds from the shale oil;

separating the high acid strength solvent from the shale oil; and diluting the separated high acid strength solvent in the presence of additional shale oil to thereby form the low acid strength solvent which selective retains nitrogen-containing compounds and selectively releases non-nitrogen-containing compounds into the additional shale oil.

2. A process as claimed in claim 1 wherein the low acid strength solvent and the high acid strength solvent comprise an organic acid selected from the group consisting of organic acids having a dissociation constant above about $1\times10^{-6}$ and mixtures thereof.

3. A process as claimed in claim 1 wherein the low acid strength solvent and the high acid strength solvent comprise an organic acid selected from the group consisting of formic acid, acetic acid and mixtures thereof.

4. A process as claimed in claim 1 wherein the high acid strength solvent contacts the separated shale oil in a volume ratio of high acid strength solvent to shale oil of from about 0.1:1 to about 4:1.

5. A process as claimed in claim 1 wherein the high acid strength solvent contacts the separated shale oil in a volume ratio of high acid strength solvent to shale oil from about 0.2:1 to about 1:1.

6. A process as claimed in claim 1 wherein the amount of water in the low acid strength solvent is in the range of from about 30% to about 95% by weight.

7. A process as claimed in claim 1 wherein the amount of water in the low acid strength solvent is in the range of from about 50% to about 70% by weight.

8. A process as claimed in claim 1 wherein the amount of water in the high acid strength solvent is in the range of from about 0% to about 50% by weight.

9. A process as claimed in claim 1 wherein the amount of water in the high acid strength solvent is in the range of from about 10% to about 30% by weight.

10. A process for removing nitrogen-containing compounds from shale oil, comprising:

contacting shale oil containing nitrogen-containing compounds in a first extraction zone with a low acid strength solvent comprising water and at least one additional component selected from the group consisting of acids having a dissociation constant greater than about $1\times10^{-6}$ and salts thereof;

separating the shale oil from the low acid strength solvent;

contacting the separated shale oil in a second extraction zone with high acid strength solvent comprising water and the same additional component or ratio of components as in the low acid strength solvent wherein the concentration of the additional component is greater than in the low acid strength solvent sufficiently to extract nitrogen-containing compounds and non-nitrogen containing compounds from the shale oil;

separating the high acid strength solvent from the shale oil;

introducing additional shale oil containing nitrogen-containing compounds to the first extraction zone; and passing the separated high acid strength solvent containing nitrogen-containing compounds to the first extraction zone and diluting the separated high strength acid solvent sufficiently to form the low acid strength solvent and wherein the dilution results in the selective retention of nitrogen-containing compounds by the formed low acid strength solvent and the selective partition of non-nitrogen-containing compounds from the formed low acid strength solvent into the shale oil.

11. A process as claimed in claim 10 wherein the low acid strength solvent and the high acid strength solvent comprise water and an organic acid selected from the group consisting of organic acids having a dissociation constant above about $1\times10^{-6}$ and mixtures thereof.

12. A process as claimed in claim 10 wherein the low acid strength solvent and the high acid strength solvent comprise water and an organic acid selected from the group consisting of formic acid, acetic acid and mixtures thereof.

13. A process as claimed in claim 10 wherein the volume ratio of high acid strength solvent to shale oil in the second extraction zone is in the range of from about 0.1:1 to about 4:1.

14. A process as claimed in claim 10 wherein the volume ratio of high acid strength solvent to shale oil in the second extraction zone is in the range of from about 0.2:1 to about 1:1.

15. A process as claimed in claim 10 wherein the amount of water in the low acid strength solvent is in the range of from about 30% to about 95% by weight.

16. A process as claimed in claim 10 wherein the amount of water in the low acid strength solvent is in the range of from about 50% to about 70% by weight.

17. A process as claimed in claim 10 wherein the amount of water in the high acid strength solvent is in the range of from about 0% to about 50% by weight.

18. A process as claimed in claim 10 wherein the amount of water in the high acid strength solvent is in the range of from about 10% to about 30% by weight.

19. A process for removing nitrogen-containing compounds from shale oil, comprising:

introducing shale oil containing nitrogen-containing compounds to a first extraction zone comprising a substantially immiscible low acid strength solvent capable of selectively extracting nitrogen-containing compounds from shale oil, said low acid strength solvent comprising water and at least one acidic component selected from the group consisting of organic acids having a dissociation constant greater than about $1\times10^{-6}$;

separating the shale oil from the substantially immiscible low acid strength solvent;

removing a portion of the low acid strength solvent containing nitrogen-containing compounds from the first extraction zone;

passing the shale oil from the first extraction zone to a second extraction zone comprising substantially immiscible high acid strength solvent having a lower selectivity for extracting nitrogen-containing compounds from shale oil than the low acid strength solvent for a time sufficient to extract nitrogen containing compounds and a non-nitrogen containing compounds from the shale oil, said high acid strength solvent comprising water and the same acidic component or ratio of acidic components as in the low acid strength solvent and wherein the concentration of acidic component is greater than in the low acid strength solvent;

separating the substantially immiscible high acid strength solvent containing at least a portion of the nitrogen-containing compounds and non-nitrogen containing compounds from the shale oil;

introducing additional shale oil containing nitrogen-containing compounds to the first extraction zone; and passing the separated high acid strength solvent containing nitrogen-containing compounds and non-nitrogen-containing compounds to the first extraction zone and diluting the high strength acid solvent with water to thereby form the low acid strength solvent, said dilution resulting in the selective retention of nitrogen-containing compounds by the formed low acid strength solvent and the selective partition of non-nitrogen-containing compounds from the formed low acid strength solvent into the additional shale oil.

20. A process as claimed in claim 19 wherein the low acid strength solvent and the high acid strength solvent comprise an organic acid selected from the group consisting of formic acid, acetic acid and mixtures thereof.

21. A process as claimed in claim 19 wherein the volume ratio of high acid strength solvent to shale oil in the second extraction zone is in the range of from about 0.1:1 to about 4:1.

22. A process as claimed in claim 19 wherein the volume ratio of high acid strength solvent to shale oil in the second extraction zone is in the range of from about 0.2:1 to about 1:1.

23. A process as claimed in claim 19 wherein the amount of water in the low acid strength solvent is in the range of from about 30% to about 95% by weight.

24. A process as claimed in claim 19 wherein the amount of water in the low acid strength solvent is in the range of from about 50% to about 70% by weight.

25. A process as claimed in claim 19 wherein the amount of water in the high acid strength solvent is in the range of from about 0% to about 50% by weight.

26. A process as claimed in claim 19 wherein the amount of water in the high acid strength solvent is in the range of from about 10% to about 30% by weight.

27. A process for removing nitrogen-containing compounds from shale oil, comprising:

introducing shale oil containing nitrogen-containing compounds to a first extraction zone containing low acid strength solvent comprising water in an amount of from about 30% to about 95% by weight and at least one acidic component selected from the group consisting or organic acids having a dissociation constant greater than about $1\times10^{-6}$;

separating a portion of the shale oil from the low acid strength solvent;

removing a portion of the low acid strength solvent from the first extraction zone;

passing the separated shale oil from the first extraction zone to a second extraction zone;

introducing high acid strength solvent to the second extraction zone in an amount sufficient to provide a volume ratio of high acid strength solvent to shale oil in the range of about 0.1:1 to about 4:1, said high acid strength solvent comprising water, in a lesser amount than contained in the low acid strength solvent and from about 0% to about 50% by weight, and the same acidic component as in the low acid strength solvent, for a time sufficient to extract nitrogen-containing compounds and non-nitrogen-containing compounds from the shale oil;

separating a portion of the high acid strength solvent containing nitrogen-containing compounds and non-nitrogen containing compounds from the shale oil; and passing the separated high acid strength solvent containing nitrogen-containing compounds and non-nitrogen-containing compounds to the first extraction zone containing shale oil containing nitrogen-containing compounds and low acid strength solvent and diluting the high strength acid solvent to thereby form additional low acid strength solvent, wherein the dilution results in the selective retention of nitrogen containing compounds by the formed low acid strength solvent and the selective partition of non-nitrogen-containing compounds from the formed low acid strength solvent into the shale oil.

28. A process as claimed in claim 27 wherein the low acid strength solvent and the high acid strength solvent comprise water and an organic acid selected from the group consisting of formic acid, acetic acid and mixtures thereof.

29. A process as claimed in claim 28 wherein the amount of water in the low acid strength solvent is from about 50% to about 70% by weight.

30. A process as claimed in claim 29 wherein the volume ratio of high acid strength solvent to shale oil in the second extraction zone is from about 0.2:1 to about 1:1.

31. A process as claimed in claim 28 wherein the amount of water in the high acid strength solvent is from about 10% to about 30% by weight.

32. A process for removal of nitrogen-containing compounds from oil, comprising:

countercurrently contacting oil with a solvent for nitrogen-containing compounds, said solvent comprising an aqueous liquid substantially immiscible with the oil and an acidic component dissolved in the liquid, the solvent characterized by having a greater selectivity for nitrogen-containing compounds at a relatively lower concentration of such component and a smaller selectivity for nitrogen-containing compounds at a relatively higher concentration of such component, for a time sufficient for the solvent to extract nitrogen-containing compounds and non-nitrogen-containing compounds from the oil; and diluting the solvent with such substantially immiscible aqueous liquid between initial contact between the oil and the solvent and final contact between the oil and the solvent, said dilution resulting in the selective retention of nitrogen-containing compounds by the diluted solvent and the selective partition of non-nitrogen-containing compounds from the diluted solvent into the oil.

33. A process as claimed in claim 32 wherein the solvent comprises water and at least one additional component selected from the group consisting of acids having a dissociation constant greater than about $1\times10^{-6}$ and salts thereof.

34. A process as claimed in claim 32 wherein the solvent comprises water and an organic acid selected from the group consisting of organic acids having a dissociation constant greater than about $1\times10^{-6}$ and mixtures thereof.

35. A process as claimed in claim 32 wherein the solvent comprises water and an organic acid selected from the group consisting of acetic acid, formic acid and mixtures thereof.

36. A process for removing nitrogen-containing compounds in shale oil comprising:

introducing a first solvent stream comprising high acid strength solvent having a low selectivity for nitrogen-containing compounds from shale oil to the upper end of a multi-stage extraction vessel and passing said first solvent stream toward the lower end of the extraction vessel;

diluting the first solvent stream at a location between the upper and lower ends of the extraction vessel to thereby form a second solvent stream in the lower end of the extraction vessel comprising low acid strength solvent having higher selectivity for nitrogen-containing compounds which exits the lower end of the extraction vessel and forms low acid strength solvent extract;

introducing a stream of shale oil to the lower end of the extraction vessel and passing said shale oil stream from the lower end of the extraction vessel to the upper end of the extraction vessel thereby contacting the first solvent stream comprising high acid strength solvent in the upper end of the extraction vessel wherein nitrogen-containing compounds and non-nitrogen-containing compounds are extracted from the shale oil by the first solvent stream and contacting the second solvent stream comprising low acid strength solvent in the lower end of the extraction vessel wherein dilution of the first solvent stream results in the selective retention of nitrogen-containing compounds by the second solvent stream and the selective partition of non-nitrogen-containing compounds from the second solvent stream into the shale oil stream; and separating the shale oil stream from the first solvent stream.

37. A process as claimed in claim 36 wherein the low acid strength solvent and the high acid strength solvent comprise water and at least one additional component selected from the group consisting of acids having dissociation constants greater than about $1\times10^{-6}$ and salts thereof.

38. A process as claimed in claim 36 wherein the low acid strength solvent and the high acid strength solvent comprise water and an organic acid selected from the group consisting of organic acids having a dissociation constant above about $1\times10^{-6}$ and mixtures thereof.

39. A process as claimed in claim 36 wherein the low acid strength solvent and the high strength acid solvent comprise water and an organic acid selected from the group consisting of formic acid, acetic acid and mixtures thereof.

40. A process for removing nitrogen-containing compounds in shale oil comprising:

introducing a first solvent stream comprising high acid strength solvent comprising water and at least one acidic component selected from the group consisting of organic acids having dissociation constants greater than about $1\times10^{-6}$ to the upper end of an extraction vessel and passing said first solvent stream toward the lower end of the extraction vessel;

diluting the first solvent stream with water at a location between the ends of the extraction vessel to thereby form a second solvent stream in the lower end of the extraction vessel comprising low acid strength solvent comprising water, in an amount greater than in the high acid strength solvent, and the same acidic component as in the high acid strength solvent;

withdrawing low acid strength solvent from the lower end of the extraction vessel;

introducing a stream of shale oil to the lower end of the exctraction vessel and passing said shale oil stream from the lower end of the extraction vessel toward the upper end of the extraction vessel to thereby contact countercurrently first the second solvent stream comprising low acid strength solvent and then the first solvent stream comprising high acid strength solvent wherein contact between the shale oil stream and the first solvent stream results in the extraction of nitrogen-containing and non-nitrogen-containing compounds from the shale oil and wherein dilution of the first solvent stream to form the second solvent stream results in selective retention of nitrogen-containing compounds by the second solvent stream and selective partition of non-nitrogen-containing compounds from the second solvent stream into the shale oil stream; and separating the shale oil stream from the first solvent stream.

41. A process as claimed in claim 40 wherein the low acid strength solvent and the high acid strength solvent comprise water and an organic acid selected from the group consisting of formic acid, acetic acid and mixtures thereof.

42. A process as claimed in claim 40 wherein the volume ratio of high acid strength solvent to shale oil is from about 0.1:1 to about 4:1.

43. A process as claimed in claim 40 wherein the volume ratio of high acid strength solvent to shale oil is from about 0.2:1 to about 1:1.

44. A process as claimed in claim 40 wherein the amount of water in the low acid strength solvent is from about 30% to about 95% by weight.

45. A process as claimed in claim 40 wherein the amount of water in the low acid strength solvent is from about 50% to about 70% by weight.

46. A process as claimed in claim 40 wherein the amount of water in the high acid strength solvent is from about 0% to about 50% by weight.

47. A process as claimed in claim 40 wherein the amount of water in the high acid strength solvent is from about 10% to about 30% by weight.

* * * * *